US005752879A

United States Patent [19]

Berdut

[11] Patent Number: 5,752,879

[45] Date of Patent: May 19, 1998

[54] TILTABLE MULTI-PURPOSE EXERCISE GYM APPARATUS

[76] Inventor: Elberto Berdut, Orquidea No. 98, Santa Maria, Guaynabo, Puerto Rico, 00926

[21] Appl. No.: 572,797

[22] Filed: Dec. 13, 1995

[51] Int. Cl.[6] ..... A63B 21/068

[52] U.S. Cl. ..... 482/96; 482/92; 482/142; 482/903

[58] Field of Search ..... 482/51, 72, 92, 482/95, 96, 136, 137, 142, 903

[56] References Cited

U.S. PATENT DOCUMENTS

| | | | |
|---|---|---|---|
| 682,988 | 9/1901 | Hazelip | 482/96 |
| 1,026,179 | 5/1912 | Regan | 482/72 X |
| 2,783,045 | 2/1957 | Bosch | 482/96 |
| 4,272,071 | 6/1981 | Sferle | 482/96 |
| 4,468,025 | 8/1984 | Sferle | 482/96 |
| 4,911,438 | 3/1990 | Van Straaten | 482/96 |
| 5,066,005 | 11/1991 | Lvecke | 482/96 |
| 5,125,884 | 6/1992 | Weber et al. | 482/142 X |

*Primary Examiner*—Richard J. Apley
*Assistant Examiner*—John Mulcahy
*Attorney, Agent, or Firm*—Ronald P. Kananen

[57] ABSTRACT

A table is slidably supported on a chassis which is tiltably supported on a base or support frame. A motorized tilt control device allows the chassis and table to be tilted and the weight of the user made available to produce a load against which exercising can be carried out. The movement of the chassis is dampened using magnetic dampening units.

9 Claims, 10 Drawing Sheets

TILTABLE MULTI-PURPOSE EXERCISE GYM APPARATUS

BACKGROUND OF THE INVENTION

1. Field of the Invention

The present invention relates to an item of exercise equipment which enables a user to perform a plurality of different exercises. More specifically, the present invention relates to exercise equipment which utilizes the weight of the user to provide a load against which the person must exercise and which varies the load simply by changing the angle at which the apparatus is tilted. Still more particularly, this invention relates to exercise equipment having a magnetic damper.

2. Description of the Related Art

Hitherto, various types of exercise apparatus have been proposed. A large number of these devices have relied upon springs, weights or even elastomeric members to provide resistance against which exercise can be performed. Other devices have attempted to make use of the body weight of the person in order to provide an exercise resistance, but have been limited to one or two different bench-press and riding types of exercises. Further, these types of machines are intended for use by people who are in good health and wish to improve their physical condition; however, they are usually not suited for elderly and disabled people such as those who suffer from muscular dystrophy, or who have spinal or heart problems, for example.

Therefore, there has been a need for exercise equipment which is simple, sturdy, allows a good variety of different exercises to be performed, and which is readily adjustable.

SUMMARY OF THE INVENTION

It is an object of the present invention to provide an exercise or gym machine which provides essentially all of the needs of both amateur and professional athletes by enabling a large number of different types of exercises to be carried out and for the load to be varied simply by tilting the apparatus in a manner which causes the person's own body weight to provide the resistance against which exercise must be carried out.

It is a further object of the invention to provide an exercise machine which can, at the touch of a button, vary the exercise load by tilting the angle of the device under the control of a suitable servomotor.

It is a further object of the invention to provide an exercise machine which is readily combinable with EKG systems and which facilitates a doctor's monitoring of a patient during "stress tests" or the like.

It is another object of the invention to provide an exercise machine which permits a number of accessories to be connected in a manner which permits an increase in the variety of different exercises that may be performed.

It is a further object of the invention to provide an exercise machine which has a magnetic damper.

In brief, the present invention features a table which is slidably supported on a chassis that is tiltably supported on a base or support frame. By tilting the chassis and table, the weight of the user is available to produce a load against which exercising can be carried out.

More specifically, a first aspect of the invention resides in an exercising machine which comprises: a support frame; a chassis supported on the support frame so as to be selectively tiltable at an angle with respect to a horizontal plane; an angle adjustment device interconnecting the support frame and the chassis, the angle adjustment device maintaining a selected tilt angle of the chassis with respect to the horizontal plane; and a slidable table slidably supported on the tiltable chassis, the table being adapted to support a person and to be tiltable at the same angle as the chassis.

A further feature of the present invention resides in that the above type of angle adjustment device comprises: an electric motor; a extensible strut which comprises of a male member and a female member that are threadedly interconnected in a manner wherein relative rotation varies the length of the strut; a gear which interconnects the electric motor and the extensible strut; and a remote control which is connected to the electric motor through a cable for controlling the direction in which the motor is energized.

Another feature of the present invention resides in that the exercising machine further comprises: a foot rest; first foot rest connection means provided on a second end of the table; and second foot rest connection means provided on the chassis, the first and second foot rest connection means enabling the foot rest to be selectively connected to either the table or the chassis.

Yet another aspect of the invention resides in that the exercising machine further comprises: a pair of oar anchor brackets which are fastened to each side of the chassis, the oar anchor brackets having connection means which enables the lower ends of oar members to be pivotally connected to the chassis; and a pair of horizontally extending bracket members which are connected to each side of the table, the horizontally extending bracket members being adapted to have the oars disposed therethrough.

A further feature of the present invention resides in that the exercising machine is such that the horizontally extending bracket means are also adapted to additionally acts as hand-grips and to allow a person to grip the sides of the table.

A still further feature of the present invention resides in that the chassis is provided with a pair of sockets which are adapted to receive cable connection brackets and which are provided on either side of the chassis, the cable connection brackets being provided with a plurality of spaced connection holes that enable the height at which a cable is connected to be selectively varied.

Another aspect of the present invention resides in that the table is supported on the chassis by a plurality of rollers, and wherein the chassis is provided with rail means on which the rollers can roll.

Another feature of the exercising machine according to the present invention is that the rollers are arranged in sets wherein a plurality of rollers of each set are arranged to roll on top of a rail of the rail means, and at least one roller of each set is arranged to roll on a lower side of the rail.

A further feature of the exercising machine is that it comprises a shock absorber means for damping relative movement between the table and the chassis.

Another feature of the exercising machine resides in a combination of means for limiting the amount of relative movement between the table and the chassis; and shock absorber means for damping a final amount of relative movement between the table and the chassis when the table approaches a limit of relative movement permitted by the limiting means.

A further feature of the exercising machine is that the shock absorber means comprises magnetic damper means which include: a set of stationary magnets, the stationary magnets being arranged with respect to one another so that their poles have a mirror image configuration; a set of movable magnets, the movable magnets being arranged with respect to one another so that their poles have a mirror image configurations; and a plurality of soft iron yokes which are each arranged with at least one of the stationary magnets and which are arranged so as to have a portion juxtapose a pole of a movable magnet which is the opposite in polarity to the polarity of the at least one stationary magnet which it is associated.

Another feature of the exercising machine is that the shock absorbing means comprises a plurality of damper units which are arranged in pairs on either side of the axis about which the chassis is pivotal.

BRIEF DESCRIPTION OF THE DRAWINGS

The various features and advantages of the present invention will become more clearly appreciated from the following discussion of the preferred embodiments taken in conjunction with the appended drawings in which.

DETAILED DESCRIPTION OF THE PREFERRED EMBODIMENTS

Figure 1:
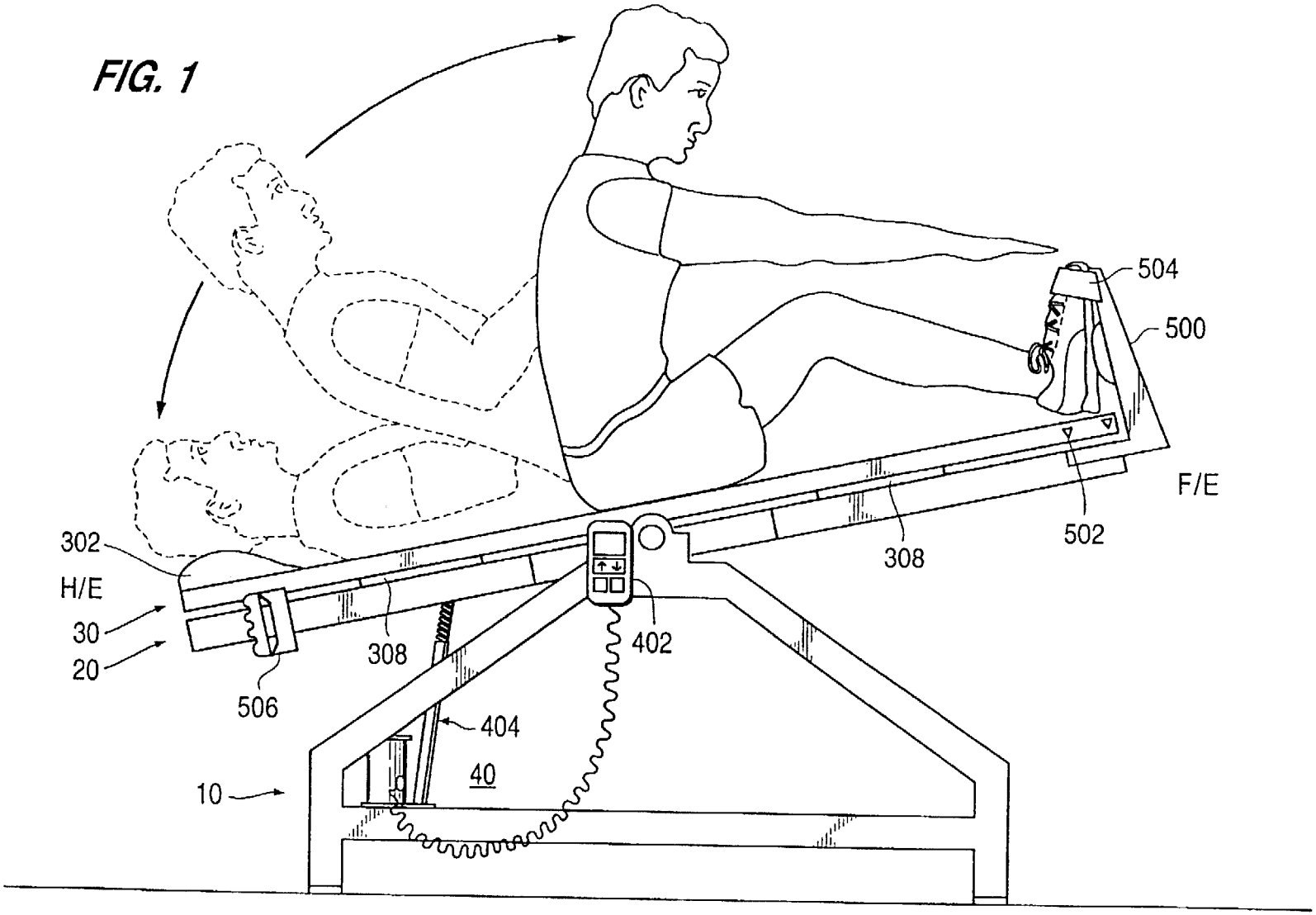
FIG. 1 is a sketch showing the present invention being used with a foot rest connected to a main chassis, and with the main chassis and a slidable table member which is supported on the chassis, oriented upwardly in a manner which allows a user to perform inclined sit-ups.

FIGS. 1 to 4 show the concept upon which the present invention is based. As will be readily appreciated from these sketches, the invention is quite simple in its physical construction and comprises only four basic elements: a base or support frame 10; a tiltable chassis 20 which is pivotally supported on the base frame 10; a table 30 which is slidably supported on the tiltable chassis 20; and a motorized tilt control arrangement 40 which controls the inclination of the chassis and table arrangement.

In this arrangement, the table 30 and chassis 20 are arranged to be tiltable in both directions through a maximum angle which is set at 45° merely by way of example, under the control of a hand-held remote controller unit 402. By tilting the table 20, it is possible to employ the body weight of the person using the apparatus to provide a load against which exercise can be carried out. In the situation depicted in FIG. 1, the table is inclined with the "foot" end (F/E) of the table elevated above the horizontal plane, and has a removable padded foot rest 500 arrangement connected to the chassis by way of wing nuts 502 or the like. In these drawings, the nuts 502 are, merely for the sake of illustration, depicted as having triangular heads and are provided on both the chassis 20 and the table 30 to enable the foot rest 500 to be connected to either.

In the illustrated arrangement, the foot rest 500 is provided with toe caps 504 which allow the user to secure his or her feet against the foot rest 500 and thus be able to apply a tractive force which acts on the muscles in the upper thigh and holds the slidable table 30 in position while sit-ups are performed to exercise muscle groups in the stomach and abdominal regions. In the situation depicted in FIG. 2, the table 30 is tilted in the reverse direction so that the "head" end (H/E) is elevated. In this position, the user is able to lie in a face-down prone position and grasp handles 506 connected to the chassis 20 in a manner which enables the person to pull against the gravitationally induced force component which acts parallel to the surface of the table 30 in a manner which induces the table 30 to slide up and down. This exercise reproduces a "chinning" type of exercise. By increasing the angle of tilt using the remote control unit 402, the amount of resistance can increased from a near zero level when the table and chassis are horizontal, to a considerable amount when the maximum degree of inclination is reached. It should be noted that the angle through which tilting is possible is not limited to the above mentioned value and that the amount of tilt can be increased to any practical maximum value.

Figure 3:
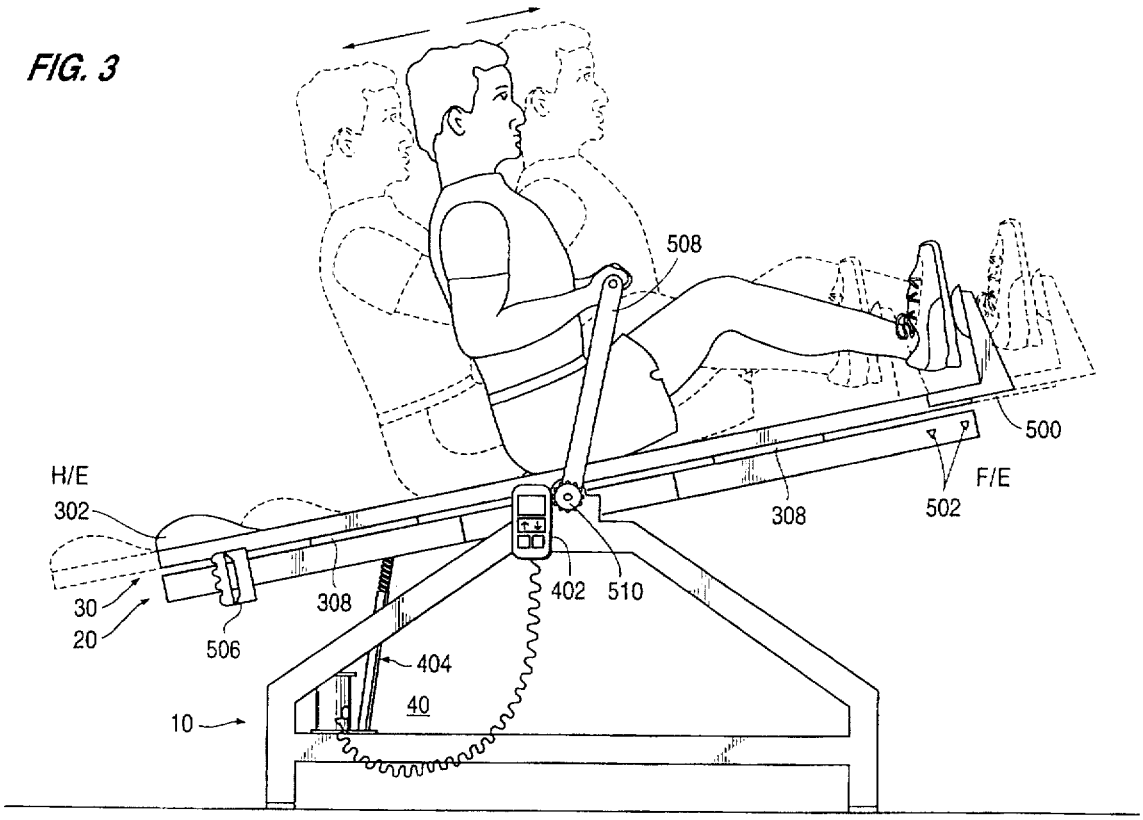
FIG. 3 is a sketch showing the foot rest connected to the slidable table top and with side handles connected to either side of the fixed chassis member in a manner which allows a "dead lift" type of exercise to be performed.
Figure 4:
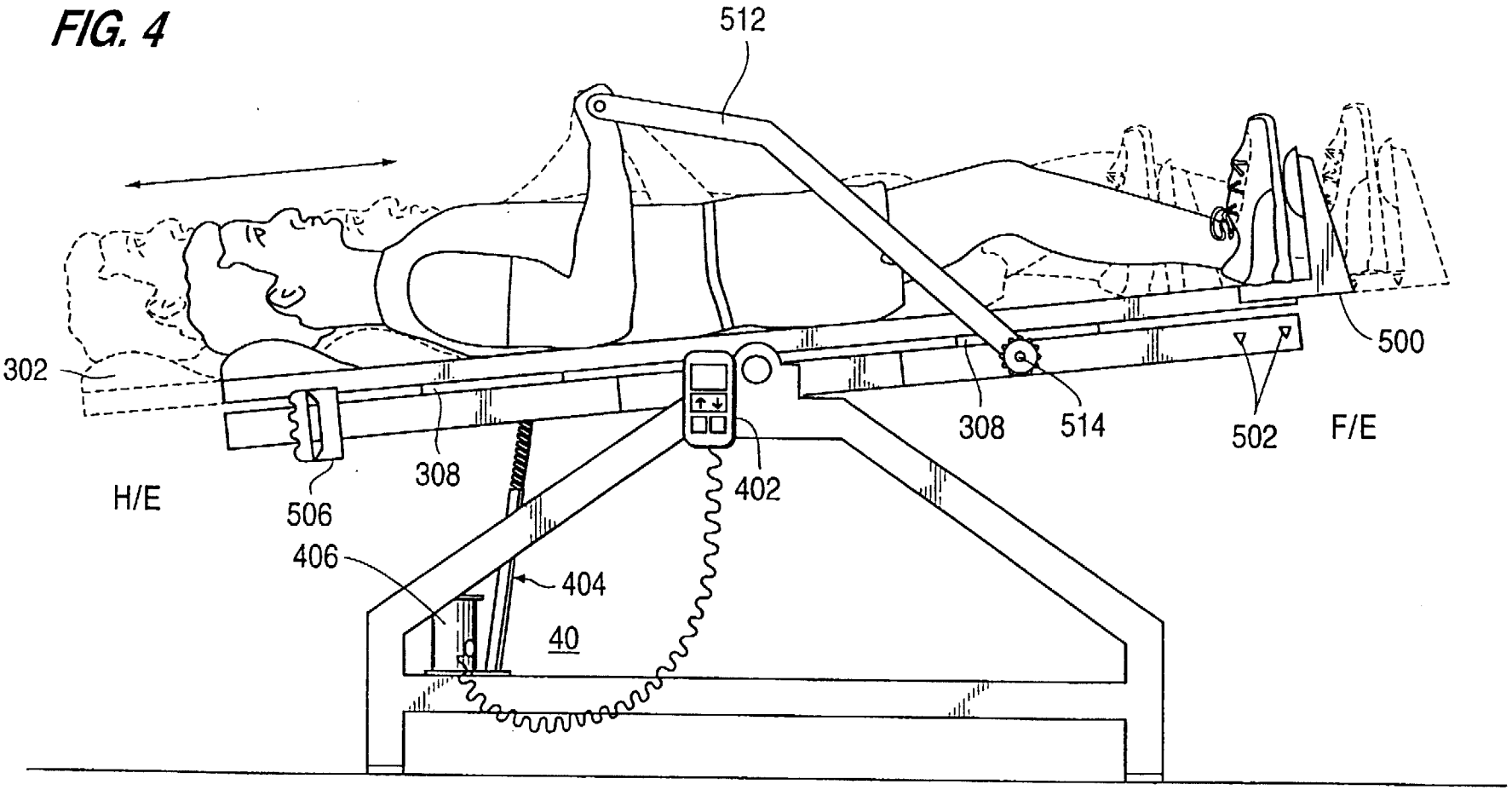
FIG. 4 is a sketch showing the apparatus and side handles angled in a manner which allows the user to execute a "dead lift" type exercise.

FIG. 3 shows the situation wherein the foot rests 500 are connected to the "foot" end (F/E) of the table 30, the "foot" end (F/E) of the table is elevated, and lever-like handles 508 are connected to the base frame 10. As will be understood, the handles 508 are connected to the base frame 10 by connection means 510 which allows the angles of the handles 508 to be selectively adjustable in a manner which allows the user to pull his or her body weight up the slope in a manner which enables a "dead lift" exercise to be carried out. In FIG. 4 the person assumes a prone face-up position with his or her head supported on a padded pillow 302 connected to the "head" end H/E of the table 30, and utilizes the invention in a manner which enables another form of "dead lift" exercise to be performed. In this case, angled lever-like handles 512 are connected to either side of the chassis 20 by adjustable fastening means 514.

Although not specifically illustrated in FIGS. 1 to 4, it is within the scope of the invention to provide a shock absorbing arrangement which slows and damps the movement of the table 30 with respect to the chassis 20 on which it is slidably supported, when the table 30 reaches either of its of travel limits in either of the "head" or "foot" directions. This shock absorbing arrangement can be comprised of one or more damping units and can be disposed in any suitable position or positions. These damping units can be arranged, for example, in pairs at each end of the chassis or even in the middle and arranged to engage suitable portions of the table 20 such as the brackets 308 which operatively provide a connection between the table 30 and the chassis 20. In addition to damping the movement of the table 30 as it approaches the end of its travel, it is within the scope of the invention to use the damping devices to add further resistance to movement and thus provide a final extra resistance against which exercise can be carried out. This additional resistance of course conveniently occurs at the end of whatever exercise stroke is being carried out.

Figure 5:
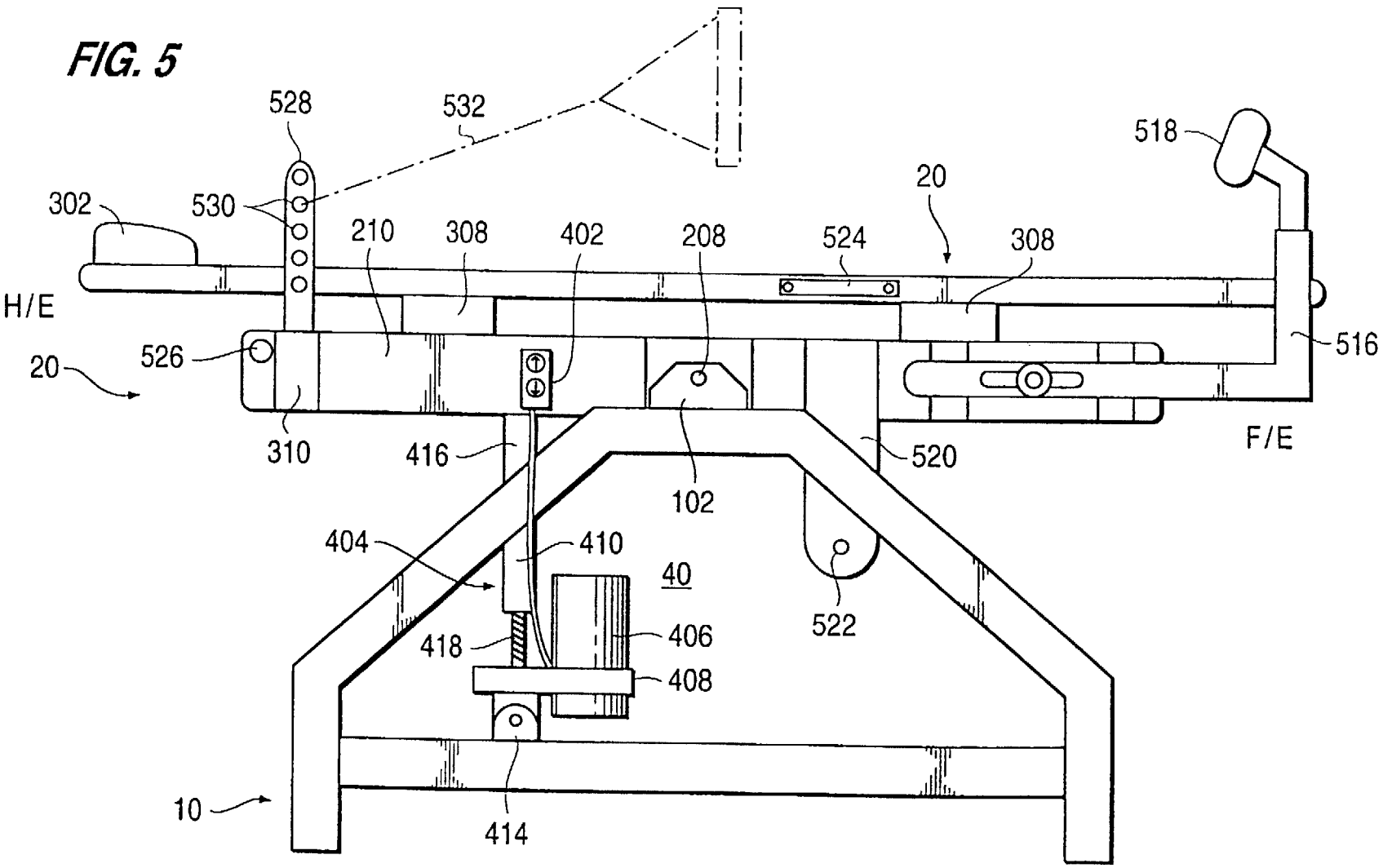
FIG. 5 is a side elevation showing a first embodiment of the invention wherein the tiltable table is set in an essentially horizontal position and wherein an adjustable foot rest is connected to the tiltable chassis member in a manner similar to that depicted in FIG. 1.
Figure 6:
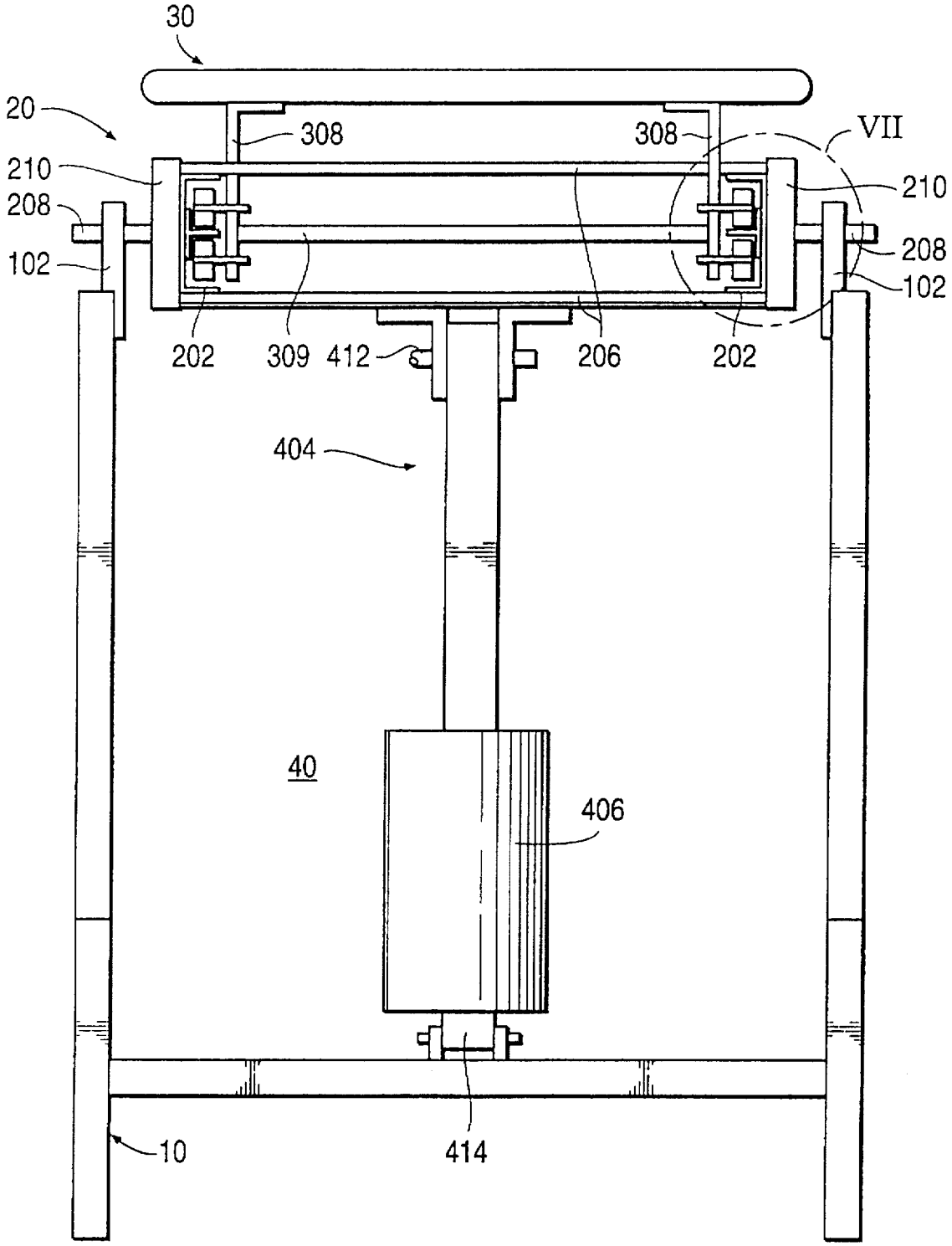
FIG. 6 is an end view showing the first embodiment as seen from the direction indicated by arrow VI in FIG. 5.
Figure 7:
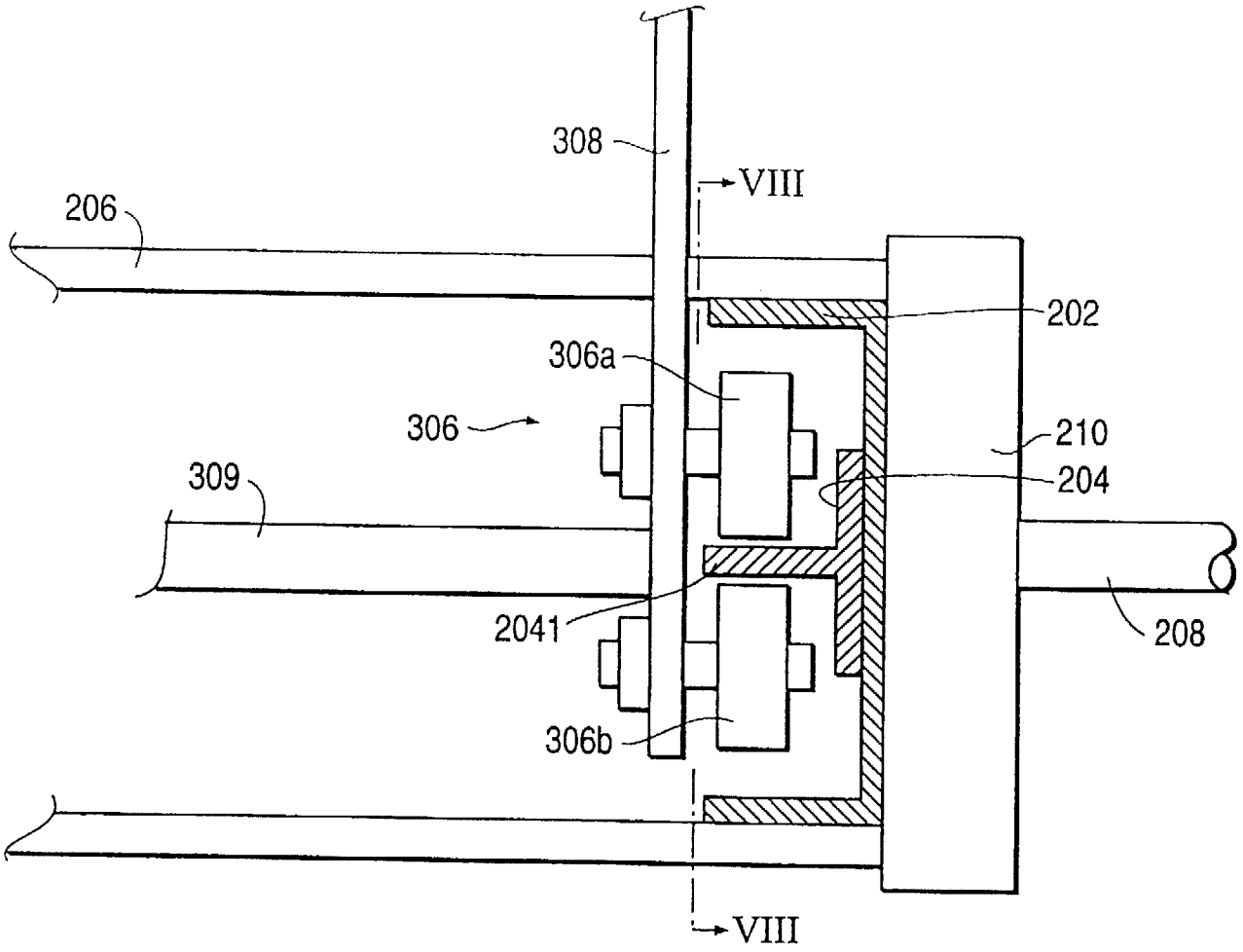
FIG. 7 is an end sectional view showing a roller and track arrangement which supports the slidable table member on the tiltable chassis.
Figure 8:
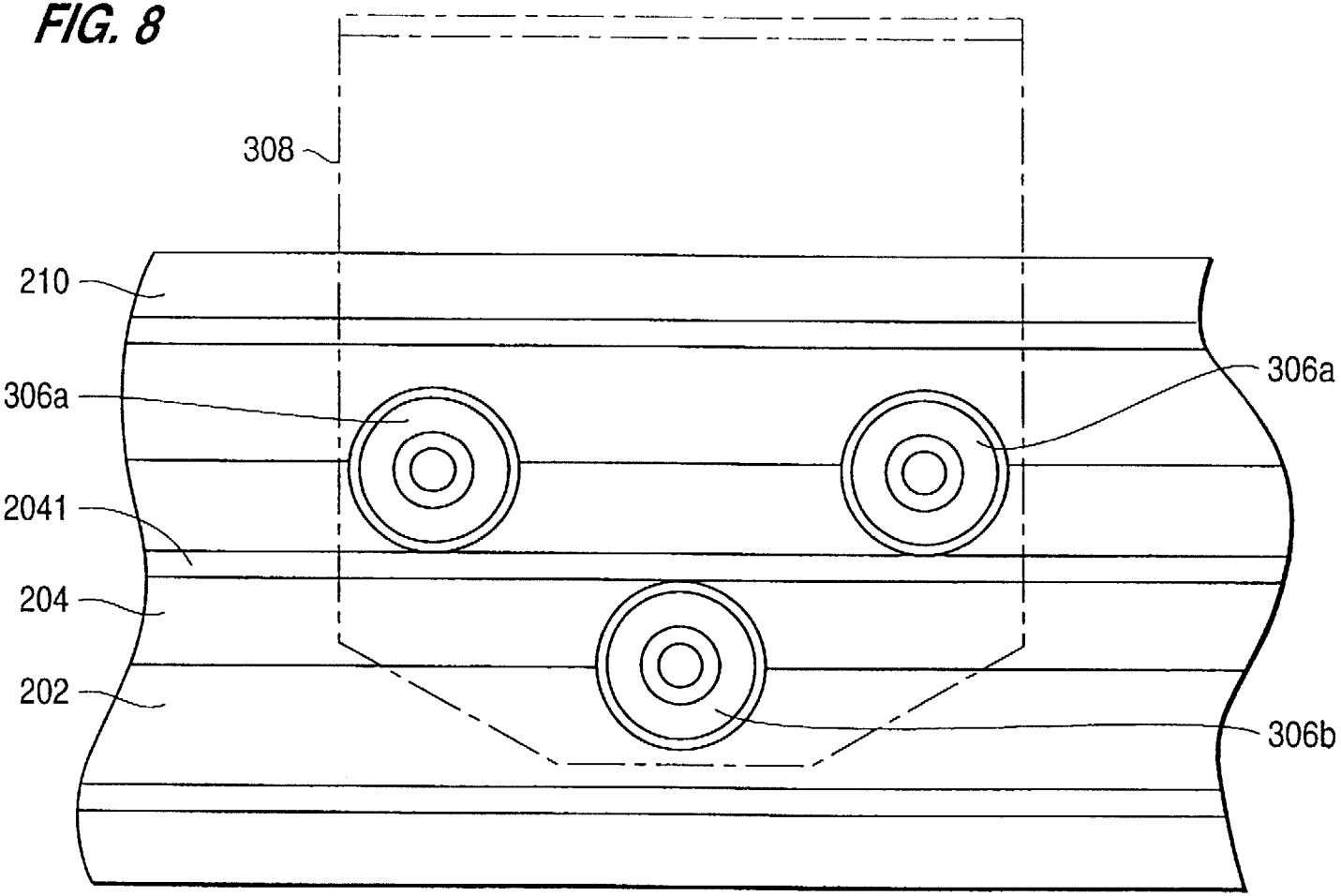
FIG. 8 is a side sectional view of the roller and track arrangement encircled in FIG. 6, as taken along section line VIII—VIII of FIG. 7.

FIGS. 5 to 7 show a first actual embodiment of the invention. In this arrangement the bed 30 is supported on the chassis 20 by way of roller arrangements 306 such as those shown in FIGS. 6 to 8. As will be appreciated from FIG. 7, the sides of the chassis 20 in this particular instance are formed of channel members 202 in which smaller pieces of T-section channel 204 are rigidly connected. The channel members 202 are interconnected by suitably spaced laterally extending brace members 206. Sets of rollers which comprise two upper support rollers 306*a* and one lower retaining roller 306*b*, are provided on each of the four support brackets 308 and are arranged to roll along the rails 2041 provided by the mirror image T-section channel 204 which are provided on either side of the chassis 20. Braces 309 extend between pairs of support brackets 308 to prevent flexure of the brackets 308 when the table 30 is moving under load.

In order to reduce noise, the rollers 306*a*, 306*b* can be roller bearing type rollers such as those used on skate boards having Nylon® or hard rubber tires. Alternatively, the rollers 306*a*, 306*b* can have steel tires and the T-section channel 204 lined on both the upper and lower sides with a suitable elastomeric sound deadening material.

The first embodiment is arranged so that the foot rest 516 can be adjusted both in a direction to allow for different leg lengths as well as vertically adjustable so as to allow the height of a foot rest pad 518 to selectively increased. A pair of rowing "oar" anchor brackets 520 are fixedly connected to the sides of the chassis 30. The lower ends of these brackets 520 are provided with suitable "oar" anchor pins 522 which allow the selective connection of oar members (not shown) to be pivotally connected to the anchor brackets 520 after having been passed down through horizontally extending brackets 524 fixedly connected with the sides of the table 20. It is possible that the brackets 524 also be formed in a manner which allows them to additionally serve as hand-grips which therefore enables a person seated on the table to establish a good grip on the table while performing leg exercises or the like.

Figure 2:
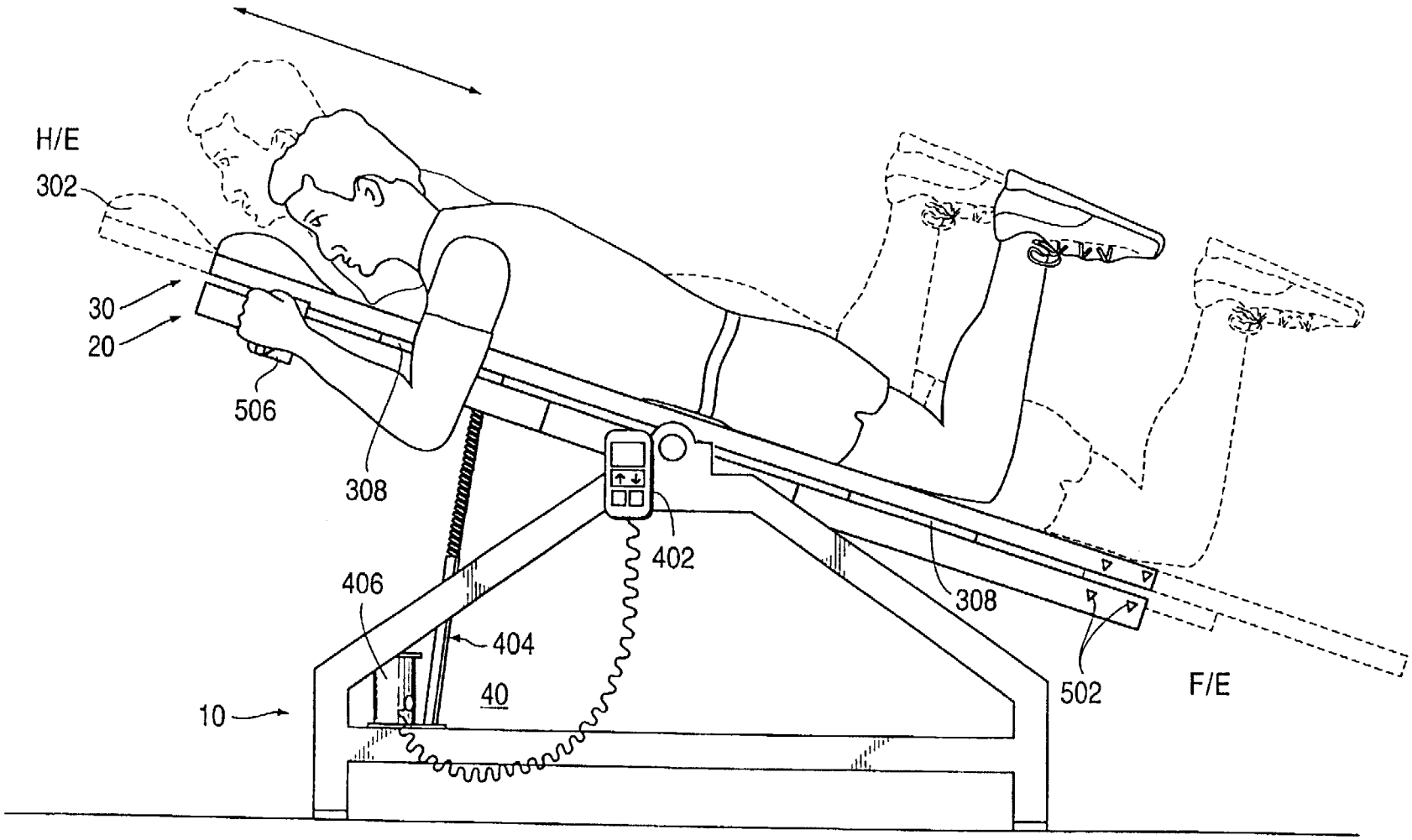
FIG. 2 is a sketch showing the present invention being used with the foot rest completely removed and the table inclined in a manner which allows the user to grip hand grips provided on either side of the tiltable chassis and the user to perform the equivalent of a "chinning" type of exercise.

The "head" end H/E of the chassis 30 is provided with a pair of horizontally extending bicycle-type hand grips 526 are provided to enable the type of exercise depicted in FIG. 2 to be carried out. Adjacent these handles 526 are a pair of sockets 310 into which cable connector brackets 528 are insertable. As shown, the cable connector brackets 528 are provided with a series of holes 530 which allow cables 532 of the type shown in phantom in FIG. 5, to be connected at different heights and used to enable various types of arm exercises to be carried out.

The tilt control 40 in this embodiment features an extendible strut 404 which is connected with an electric motor 406 through a suitable step down-gearing 408. The energization and direction of rotation of the motor 406 is controlled by the remote hand-held controller 402 which is connected with the motor 406 through a control cable 410. Both the upper and lower ends of the extensible strut 404 are pivotally connected with the chassis 20 and the base frame 10 by way of pivots 412, 414 respectively, to allow for the change in angle which occurs with tilting of the chassis 20.

In the illustrated embodiment, the extensible strut includes a helically threaded male member 416 which is threaded into a female member 418 that is provided internally with a corresponding helical thread. Although not shown in the drawings, it is possible to connect the upper end of the strut 404 to a bracket which is fixedly connected to the lower side of the chassis 20 and provided with a plurality of spaced connection holes. This enables the user to manually reconnected the upper end of the extensible strut 404 and therefore vary the maximum amount of inclination which is possible through the operation of the electric motor 406.

In this embodiment the chassis 20 is supported on the base frame 10 by two stub pivot shafts 208 which are connected at their inboard ends to the chassis 20 and which pass through mounting brackets 102. As shown in FIGS. 5 and 6, the mounting brackets 102 are rigidly connected on either side of the base frame 10. In order to render the chassis more aesthetically pleasing, covers or enclosures 210 made of colored plastic, anodized aluminum or the like, are provided on each side.

Figure 9:
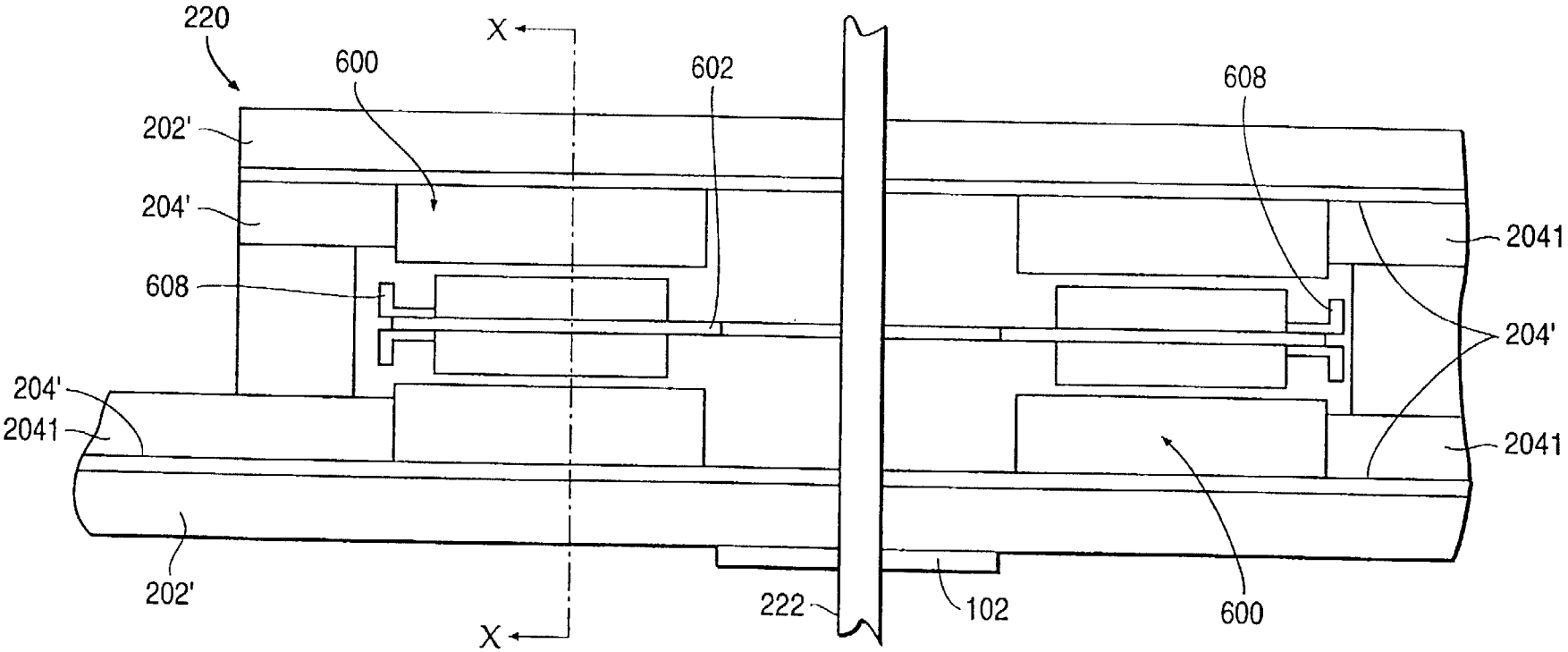
FIG. 9 is a plan view of a magnetic shock absorber which is used in a second embodiment of the invention to eliminate the dead points in the travel of the slidable table.
Figure 10:
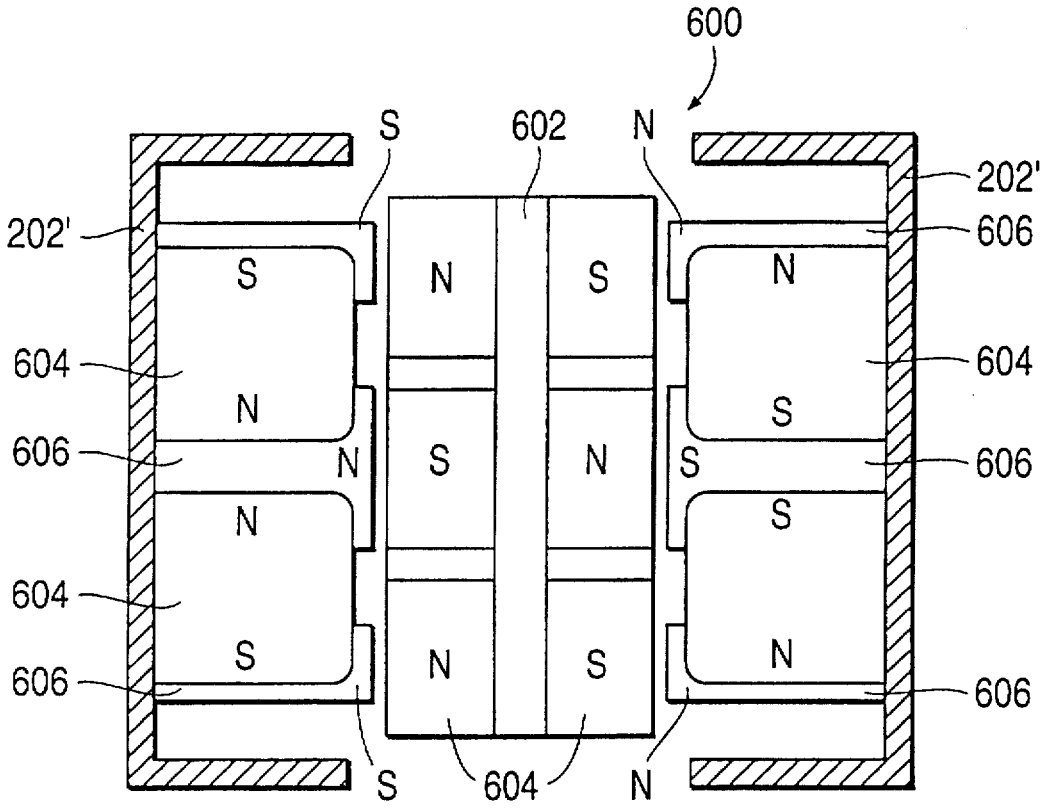
FIG. 10 is an sectional view of the magnetic shock absorber as taken along section line X—X in FIG. 9 showing an example of the arrangement of the various magnetic elements which are used in this arrangement.

FIGS. 9 and 10 show a second embodiment of the invention which features the use of a modified type of chassis structure. This chassis 20' comprises two side beams 220 each composed of two opposed channel members 202' which are arranged to enclose the roller support track and also enclose magnetic type damper units 600. As will be appreciated, these damper units 600 are provided in the center portion of each of the two parallel side beam members 220 and are disposed on either side of the shaft 222 about which the chassis 20 is pivotal. The damper units 600 are interconnected by a non-ferrous member 602 which is suitably apertured to allow for the pivot shaft 222 which in this arrangement extends completely across the width of the chassis 20'.

Although FIG. 10 shows the manner in which the ceramic permanent magnets 604 and soft iron (viz., malleable steel) yokes 606 are arranged vertically, to form the stationary and movable magnetic fields, it will be readily understood that a similar arrangement along the length of each of the damper units can also be provided in order to provide the desired damping and resistance to relative movement between the table 30 and the chassis 20 after a bracket 308 on which rollers are supported or similar element which is rigid with the table 30, come into contact with contact members 608 that are provided on the outboard sides of the units.

As will be appreciated, these type of damper units 600 do not "pump down" or require any recovery time in which to "pump up" and are particular suited to providing resistance at the end of the table travel in that continuous resistance as well as damping will be provided.

For further reference to these type of magnetic damping arrangements and the types of magnets and yokes which are used, reference may be had to the applicant's copending United States Patent Continuation-in-part application Ser. No. 08/398,171 filed on Mar. 2, 1995 in the name of Elberto Berdut, and issued on Dec. 17, 1996, as U.S. Pat. No. 5,584,367, which discloses a magnetic unit composed of a plurality of permanent magnets and soft iron yokes which act as an automotive shock absorber. General reference may also be had to U.S. Pat. No. 5,452,663 issued on Sept. 26, 1995 in the name of Berdut.

Although the present invention has been disclosed with reference to only a limited number of embodiments, it is believed that, when apprised of this disclosure and the concept upon which the present invention is based, the person of skill in art to which this invention pertains would be fully capable of practicing the invention and developing the various modifications and changes that are encompassed by the scope of the invention and limited only by the appended claims.

What is claimed is:

1. An exercising machine comprising:

a support frame;

a chassis supported on said support frame so as to be selectively tiltable at an angle with respect to a horizontal plane;

an angle adjustment device interconnecting said support frame and said chassis, said angle adjustment device maintaining a selected tilt angle of said chassis with respect to the horizontal plane;

a slidable table slidably supported on the tiltable chassis, said table being adapted to support a person and to be tiltable at the same angle as said chassis;

a pair of oar anchor brackets which are fastened to each side of said chassis, said oar anchor brackets having connection means which enables the lower ends of oars to be pivotally connected to said chassis; and a pair of horizontally extending bracket members which are connected to each side of said table, said horizontally extending bracket members being adapted to have said oars disposed therethrough.

2. An exercising machine as set forth in claim 1, wherein said horizontally extending bracket members are adapted to additionally act as hand-grips and to allow a person to grip the sides of said table.

3. An exercising machine comprising:

a support frame;

a chassis supported on said support frame so as to be selectively tiltable at an angle with respect to a horizontal plane;

a motorized angle adjustment device interconnecting said support frame and said chassis, said angle adjustment device maintaining a selected tilt angle of said chassis with respect to the horizontal plane; and a slidable table slidably supported on the tiltable chassis, said table being adapted to support a person and to be tiltable at the same angle as said chassis; and magnetic shock absorber means, including a plurality of permanent magnets, for damping relative movement between said table and said chassis.

4. An exercising machine comprising:

a support frame;

a chassis supported on said support frame so as to be selectively tiltable at an angle with respect to a horizontal plane;

an angle adjustment device interconnecting said support frame and said chassis, said angle adjustment device maintaining a selected tilt angle of said chassis with respect to the horizontal plane; and a slidable table slidably supported on the tiltable chassis, said table being adapted to support a person and to be tiltable at the same angle as said chassis; and shock absorber means for damping relative movement between said table and said chassis said shock absorber means comprising magnetic damper means comprising:

a set of stationary magnets, said stationary magnets being arranged with respect to one another so that their poles have a mirror image configuration;

a set of movable magnets, said movable magnets being arranged with respect to one another so that their poles have a mirror image configuration; and a plurality of soft iron yokes which are each arranged with at least one of said stationary magnets and which are arranged so as to have a portion juxtapose a pole of a movable magnet which is the opposite in polarity to the polarity of the at least one stationary magnet with which it is associated.

5. An exercising machine as set forth in claim 4, wherein said table is supported on said chassis by a plurality of rollers, and wherein said chassis is provided with rail means on which said rollers can roll.

6. An exercising machine as set forth in claim 5, wherein said rollers are arranged in sets wherein a plurality of rollers of each set are arranged to roll on top of a rail of said rail means, and at least one roller of each set is arranged to roll on a lower side of the rail.

7. An exercising machine as set forth in claim 4, wherein said shock absorber means is disposed with said chassis at a location proximate an axis about which said chassis is pivotally supported on said support frame.

8. An exercising machine as set forth in claim 7, wherein said shock absorber means comprises a plurality of damper units which are arranged in pairs on either side of the axis about which said chassis is pivotal.

9. An exercising machine as set forth in claim 8, wherein said damper units are arranged proximate the ends of said chassis.

* * * * *